US006719332B2

(12) United States Patent
Sekulovic

(10) Patent No.: US 6,719,332 B2
(45) Date of Patent: Apr. 13, 2004

(54) LOAD FLOOR LATCH

(75) Inventor: Ivica Sekulovic, Warwick (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/002,806

(22) Filed: Dec. 3, 2001

(65) Prior Publication Data

US 2002/0163205 A1 Nov. 7, 2002

Related U.S. Application Data

(60) Provisional application No. 60/251,021, filed on Dec. 3, 2000, and provisional application No. 60/254,602, filed on Dec. 9, 2000.

(51) Int. Cl.[7] ..... E05C 1/12

(52) U.S. Cl. ..... 292/170; 292/165; 292/DIG. 30; 292/DIG. 31

(58) Field of Search ..... 292/170, 165, 292/169, 173, DIG. 30, DIG. 31, 336.3; 70/208

(56) References Cited

U.S. PATENT DOCUMENTS

| | | | | |
|---|---|---|---|---|
| 2,186,903 A | * | 1/1940 | Gleason | 292/254 |
| 2,649,322 A | | 8/1953 | Mack | |
| 2,763,503 A | | 9/1956 | Tasch et al. | |
| 2,987,908 A | | 6/1961 | Pelcin | |
| 3,494,650 A | | 2/1970 | Slopa | |
| 3,495,862 A | | 2/1970 | McClintock | |
| 3,743,336 A | | 7/1973 | Andrews | |
| 3,782,141 A | | 1/1974 | Doerrfeld | |
| 4,138,869 A | | 2/1979 | Pelcin | |
| 4,186,952 A | | 2/1980 | Glass | |
| 4,322,958 A | | 4/1982 | Eigemeier | |
| 4,492,396 A | | 1/1985 | Luke et al. | |
| 4,542,924 A | | 9/1985 | Brown et al. | |
| 4,552,001 A | | 11/1985 | Roop | |
| 4,638,649 A | | 1/1987 | Chao | |
| 4,650,230 A | | 3/1987 | Takasaki | |
| 4,683,736 A | * | 8/1987 | Weinerman et al. | 70/208 |
| 4,704,882 A | * | 11/1987 | Takasaki | 70/215 |
| 4,969,916 A | | 11/1990 | Weinerman et al. | |
| 5,292,159 A | | 3/1994 | Sandhu et al. | |
| 5,301,989 A | * | 4/1994 | Dallmann et al. | 292/142 |
| 5,321,962 A | | 6/1994 | Ferchau et al. | |
| 5,326,141 A | * | 7/1994 | Gorman | 292/66 |
| 5,340,174 A | * | 8/1994 | Bender et al. | 292/336.3 |
| 5,413,391 A | * | 5/1995 | Clavin et al. | 292/170 |
| 5,689,980 A | * | 11/1997 | Weinerman et al. | 70/208 |
| 5,820,175 A | * | 10/1998 | Clavin | 292/165 |
| 5,878,608 A | | 3/1999 | Alyanakian | |
| 5,927,773 A | | 7/1999 | Larsen et al. | |
| 6,023,953 A | * | 2/2000 | Vickers et al. | 70/208 |
| 6,109,669 A | | 8/2000 | Pinkow | |
| 6,152,501 A | * | 11/2000 | Magi et al. | 292/336.3 |

FOREIGN PATENT DOCUMENTS

| | | | | |
|---|---|---|---|---|
| US | WO-200048870 A | * | 8/2000 | B60R/25/02 |

* cited by examiner

*Primary Examiner*—William Miller
*Assistant Examiner*—Thomas Ho
(74) *Attorney, Agent, or Firm*—Paul & Paul

(57) ABSTRACT

A latch having a housing, handle, pawl, actuator and spring. The spring biases the pawl toward the latched or extended position. The handle is pivotally attached to the housing and has a pair of actuating arms that are engageable with the actuator. The actuator is slidably supported by the housing. Lifting the handle to the open position causes sliding movement of the actuator which in turn causes the pawl to slide to the unlatched or retracted position.

7 Claims, 19 Drawing Sheets

LOAD FLOOR LATCH

CROSS-REFERENCE TO RELATED APPLICATIONS

This application claims priority to U.S. Provisional Application No. 60/251,021 filed Dec. 3, 2000 and U.S. Provisional Application No. 60/254,602 filed Dec. 9, 2000.

BACKGROUND OF THE INVENTION

1. Field of the Invention

The present invention relates to a latching device for releasably securing a closure member, such as a panel or door, in the closed position.

2. Description of the Prior Art

Trunks of automobiles are usually provided with removable load floor panels. These panels ordinarily support the weight of objects placed in the trunks of cars and are removable to allow access to a spare tire, for example, which is commonly stored under the load floor panel. It is common for the load floor panel to be held in place by gravity and a floor mat that usually covers the load floor panel. The load floor panels are usually equipped with handles that are flush with the top surface of the load floor panel in order to allow a user to remove the panel when necessary. However, this commonly used arrangement has a draw back in that the load floor panel may become dislodged when travelling over rough roads. Further, because the panel is not positively secured in place, it may become loose and rattle around in the trunk resulting in undesirable noises. The need persists in the art for a latch to positively secure such load floor panels in place.

SUMMARY OF THE INVENTION

The present invention is directed to a latch for use with closure members such as panels, drawers, doors, etc. Although the operation of the latch will be described in the context of securing the load floor panel of the trunk of an automobile, the latch of the present invention is widely applicable to many kinds of doors, windows, panels, and drawers. The latch of the present invention releasably secures a first closure member, such as a door, window, panel, or drawer, to a second closure member, such as another door, window, panel, or drawer or a frame surrounding the first closure member. The latch of the present invention includes a housing, a handle, an actuator, a coil spring, and a pawl. The latch housing has a first depression which receives the handle when the handle is in the closed position. The first depression has an essentially enclosed bottom and an open top surrounded by a bezel or flange. The latch housing further has a receptacle attached to the enclosed bottom of the first depression. The receptacle houses the coil spring and the pawl. The handle can be in the form of a paddle or a ring to facilitate grasping of the handle by a user using three or four fingers.

The latch body is installed in an aperture in the closure member using any of several well-known fasteners. The bottom receptacle houses the pawl and spring such that the pawl can move in and out of the receptacle with the spring biasing the pawl to project out of the receptacle and toward the latched position. The actuator has fins which project through the bottom of the first depression and into the receptacle and into engagement with the pawl. The handle is pivotally supported by the housing and has actuating arms that impinge upon lateral legs of the actuator. When the latch handle is lifted out of the first depression of the housing, the actuating arms of the handle retract the actuator which in turn retracts the pawl to the unlatched position. One or more beveled surfaces, provided on the underside of the pawl, cooperate with the second closure member to slide the pawl to the unlatched position as the first closure member is slammed shut. The coil spring then moves the pawl to the latched position once the pawl clears the edge of the second closure member such that the pawl will catch under the edge of the second closure member in order to secure the first closure member in place.

Another embodiment of the invention dispenses with the actuator and the actuator arms of the handle directly engage the pawl. Thus, this additional embodiment advantageously has fewer parts.

Accordingly, it is a principal object of the invention to provide a latch assembly which automatically engages a second closure member as a first closure member is slammed shut.

It is a further object of the invention to provide a latch having a low profile such that it does not project significantly above the surface of a panel to which the latch is mounted.

Still another object of the invention is to provide a latch assembly having a pivoting handle which pivots to retract the pawl to the unlatched position.

Yet another object of the invention is to provide a latch assembly having a handle which can be used to move the panel to which the latch is attached.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
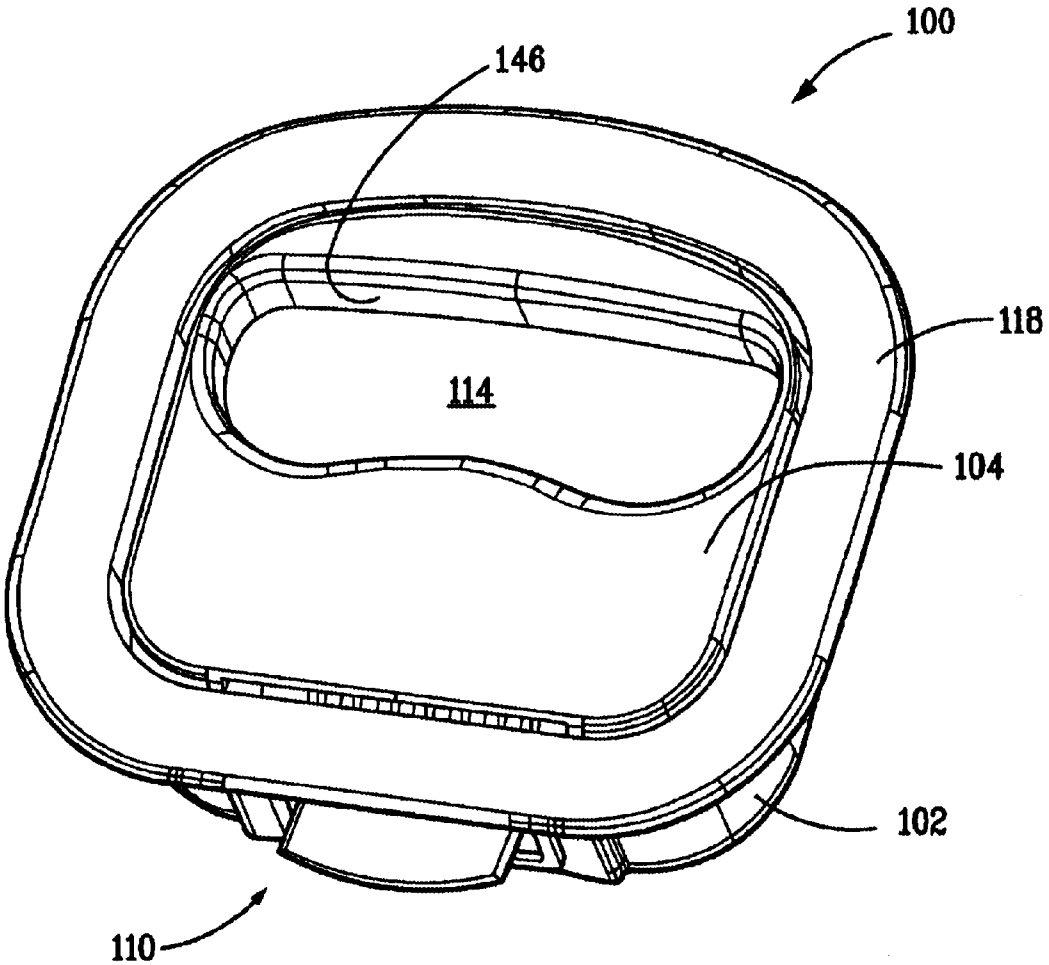
FIG. 1 is a perspective view of the latch assembly of the present invention, showing the latch assembly in the closed configuration.

Referring to FIGS. 1–22, the present invention is directed to a latch assembly 100 for use with closure members such as panels, drawers, doors, etc. Although the operation of the latch 100 will be described in the context of securing the load floor panel of the trunk of an automobile, the latch of the present invention is widely applicable to many kinds of doors, windows, panels, and drawers. The latch 100 of the present invention releasably secures a first closure member, such as a door, window, panel, or drawer, to a second closure member, such as another door, window, panel, or drawer or a frame surrounding the first closure member. The latch assembly 100 of the present invention includes a housing 102, a handle 104, an actuator 106, a coil spring 108, and a pawl 110.

Figure 21:
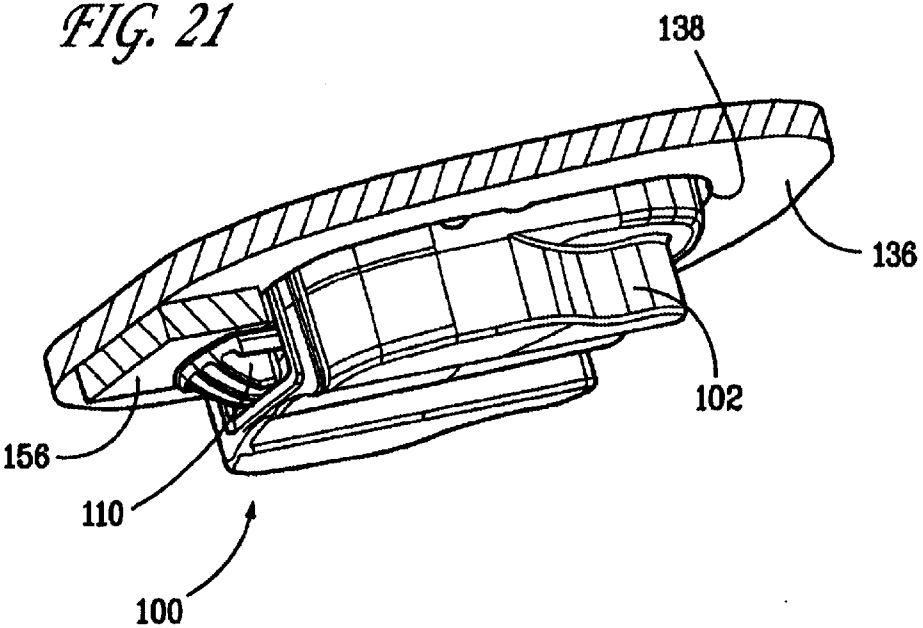
FIG. 21 is a bottom perspective view of the latch of the present invention, showing the latch in the closed or latched configuration.
Figure 22:
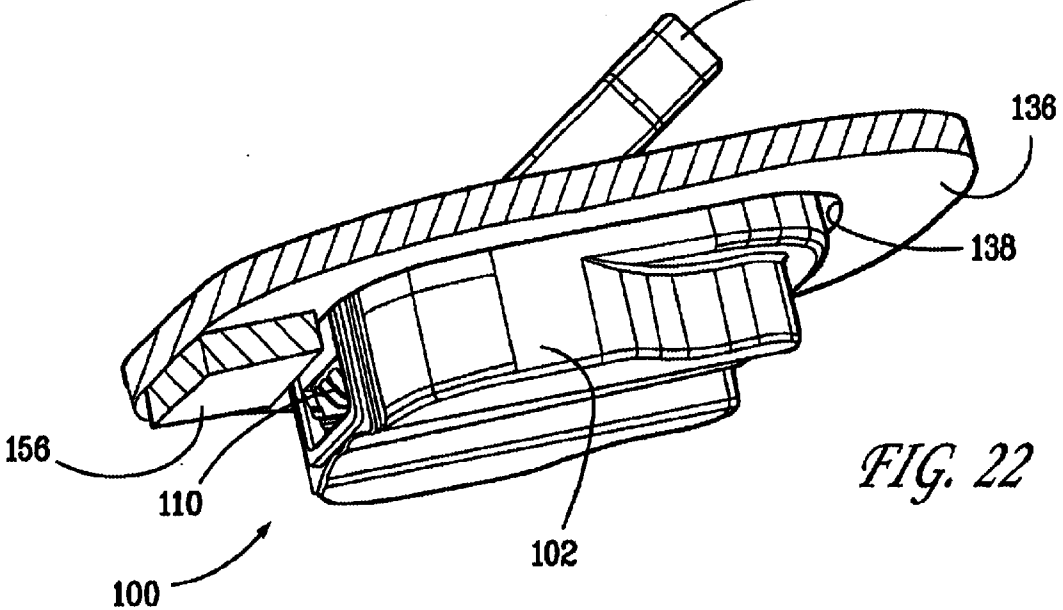
FIG. 22 is a bottom perspective view of the latch of the present invention, showing the latch in the open or unlatched configuration.

The latch housing 102 has a first cavity or depression 112 which receives the handle 104 when the handle is in the closed position shown in FIGS. 1, 2, 14, and 21. The first depression 112 has an essentially enclosed bottom 114 and an open top 116 surrounded by a bezel or flange 118. The latch housing further has a receptacle 120 attached to the underside of the enclosed bottom 114 of the first depression 112. The receptacle 120 houses the coil spring 108 and the pawl 110. The housing 102 further includes second and third cavities 122 and 124, respectively. The cavities 122 and 124 are positioned on either side of the receptacle 120 and extend downward from the bottom 114 of the cavity 112. The open tops of the cavities 122 and 124 are coplanar with the bottom 114 of the cavity 112. The cavities 122 and 124 house the actuating arms 126 and 128 of the handle 104, 104*a* and the lateral legs 130 and 132 of the actuator 106. A pair of cylindrical sleeves 134 project downward from the flange 118. Referring to FIGS. 21 and 22, the housing 102 is installed to a loadfloor panel 136 by providing an opening 138 in the loadfloor panel 136. The perimeter of the opening 138 should be smaller than the perimeter of the flange 118. The housing 102 is installed in the opening 138 with the underside of the flange 118 abutting the outer surface of the panel 136. The panel 136 should have cutouts for the sleeves 134, or be otherwise dimensioned and/or configured to allow access to the sleeves 134 from the underside of the panel 136. The housing 102 can then be secured to the panel 136 using, for example, self-tapping screws which engage the sleeves 134 from the underside of the panel 136.

Figure 2:
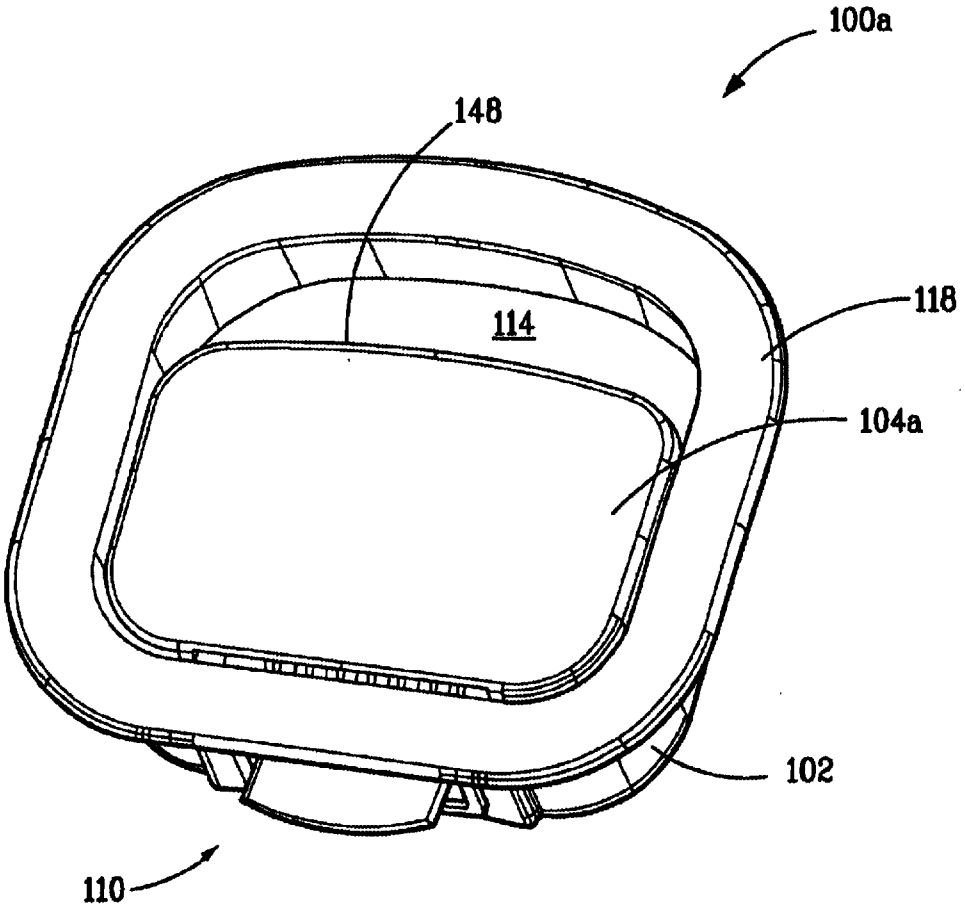
FIG. 2 is a perspective view of a second embodiment of the latch assembly of the present invention, showing the latch in the closed configuration.
Figure 4:
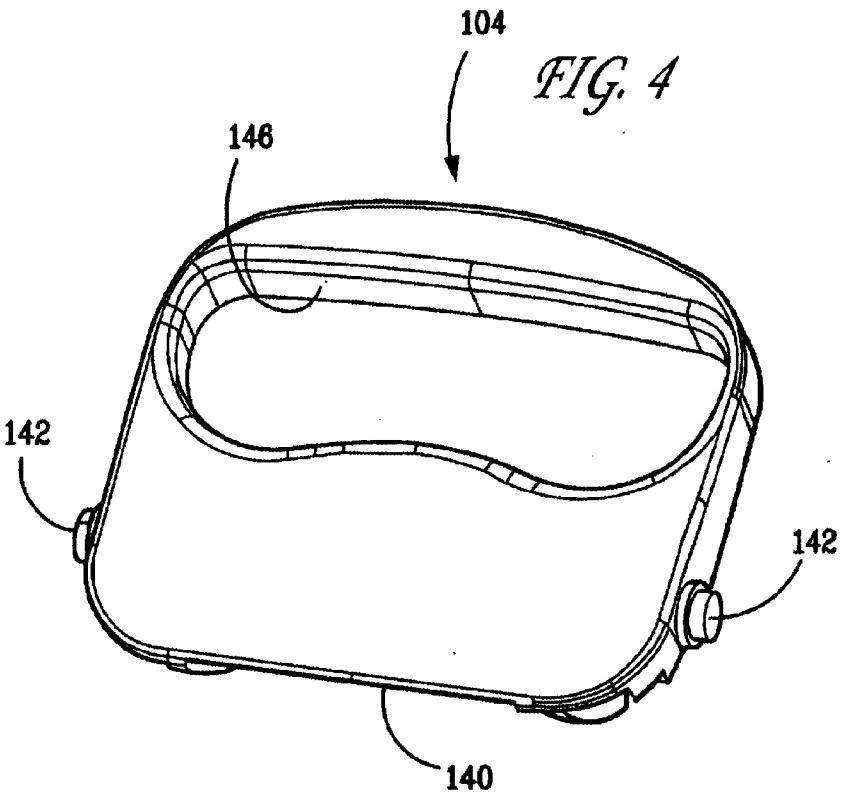
FIGS. 3–4 are views of the latch handle of the first embodiment of the present invention.
Figure 3:
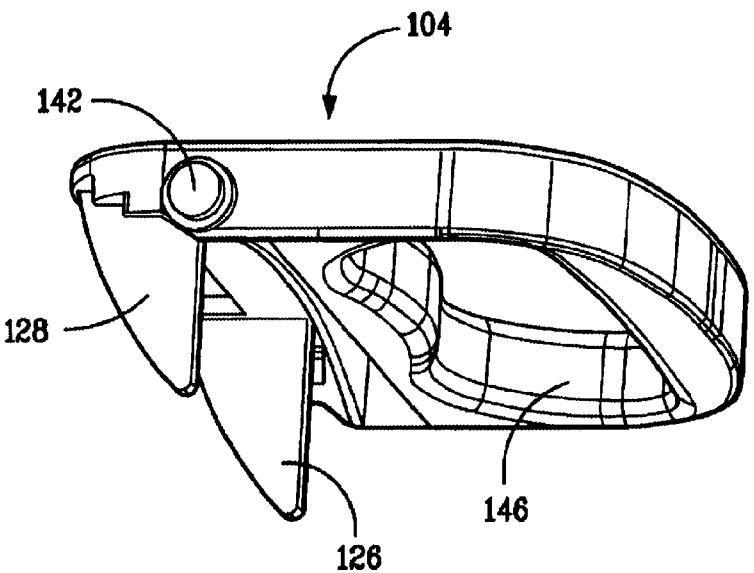
Figure 6:
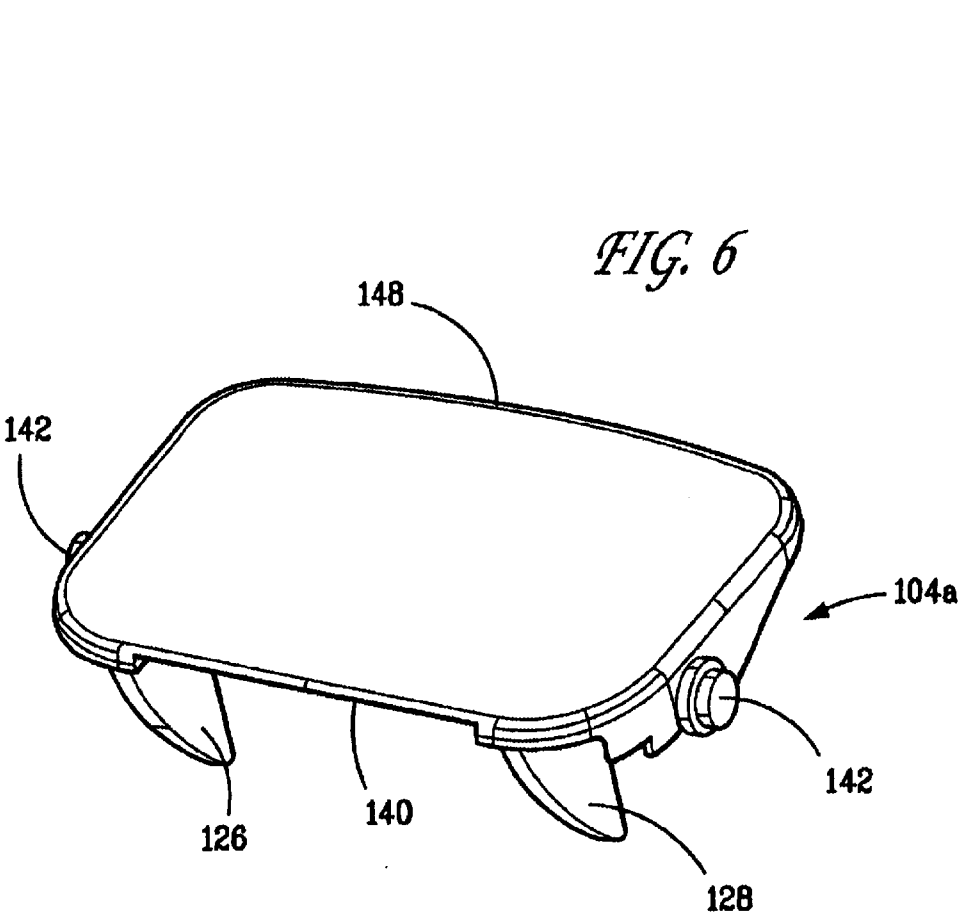
FIGS. 5–6 are views of the latch handle of the second embodiment of the present invention.
Figure 5:
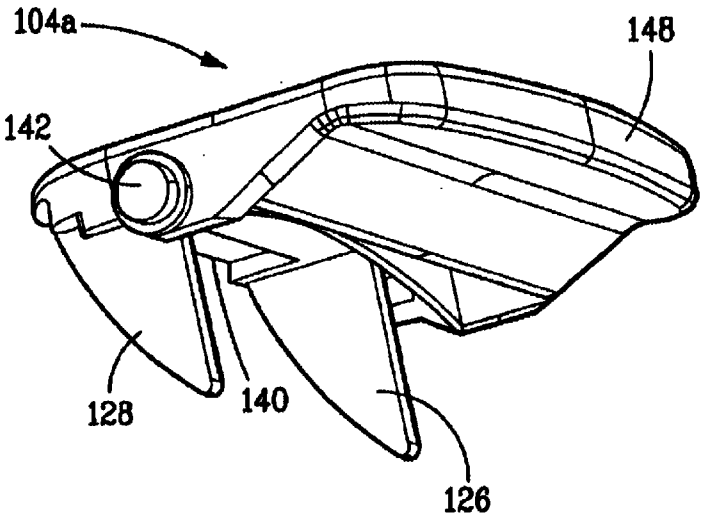
Figure 8:
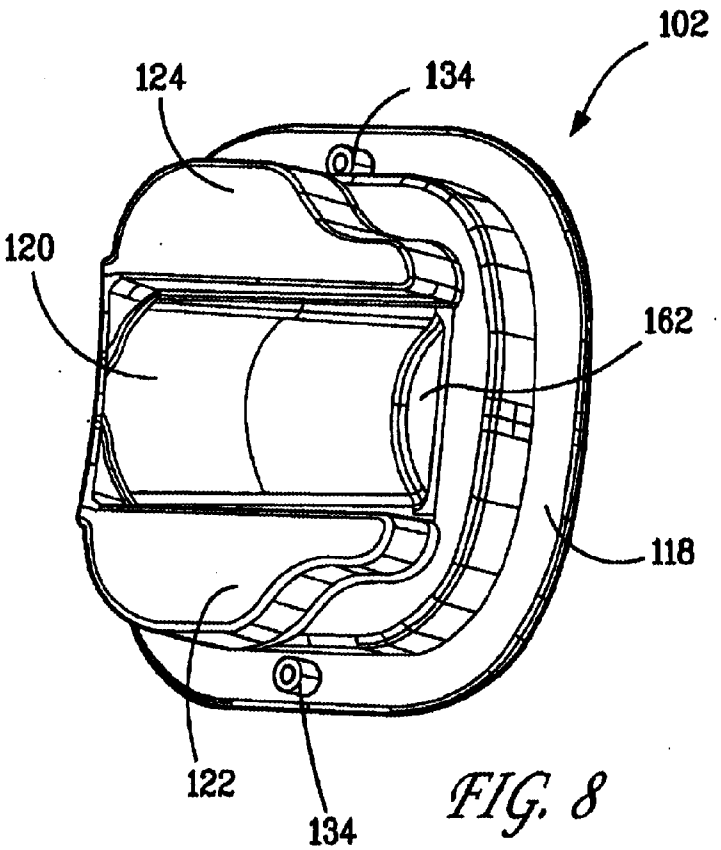
FIGS. 7–8 are views of the housing of the latch of the present invention.
Figure 7:
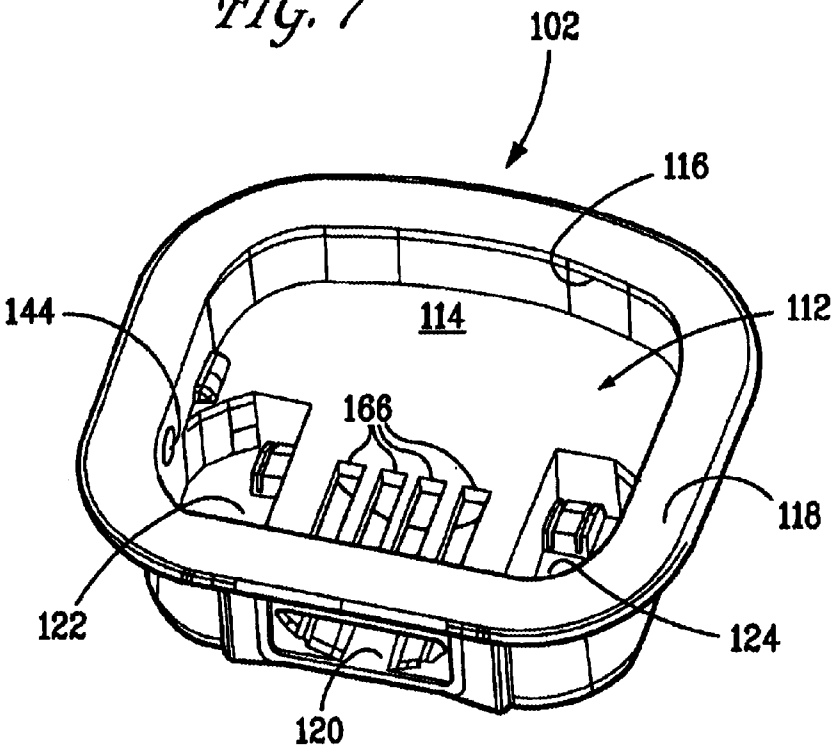
Figure 9:
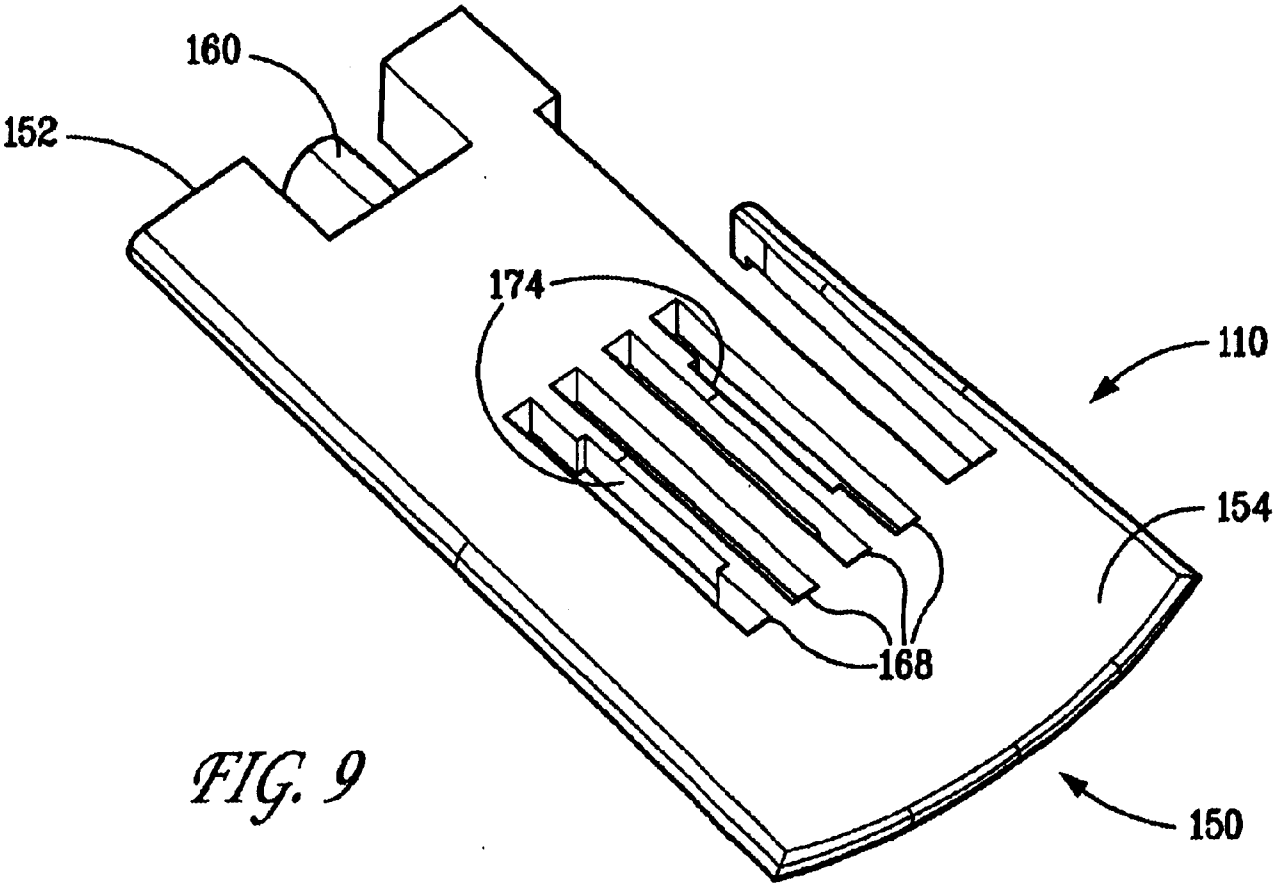
FIG. 9 is a perspective view of the pawl of the latch of the present invention.
Figure 10:
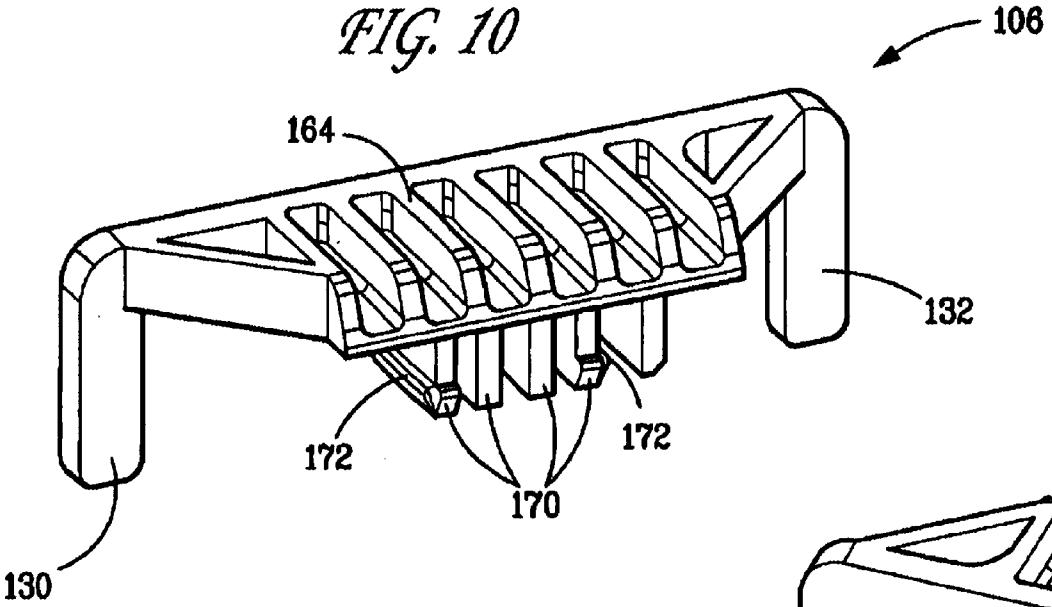
FIGS. 10–11 are views of the actuator of the latch of the present invention.
Figure 11:
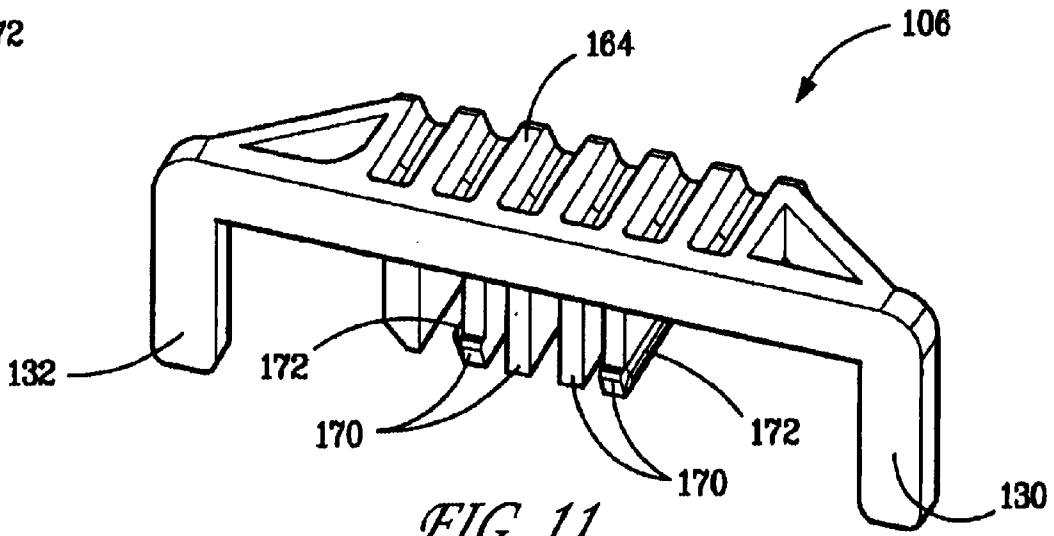
Figure 12:
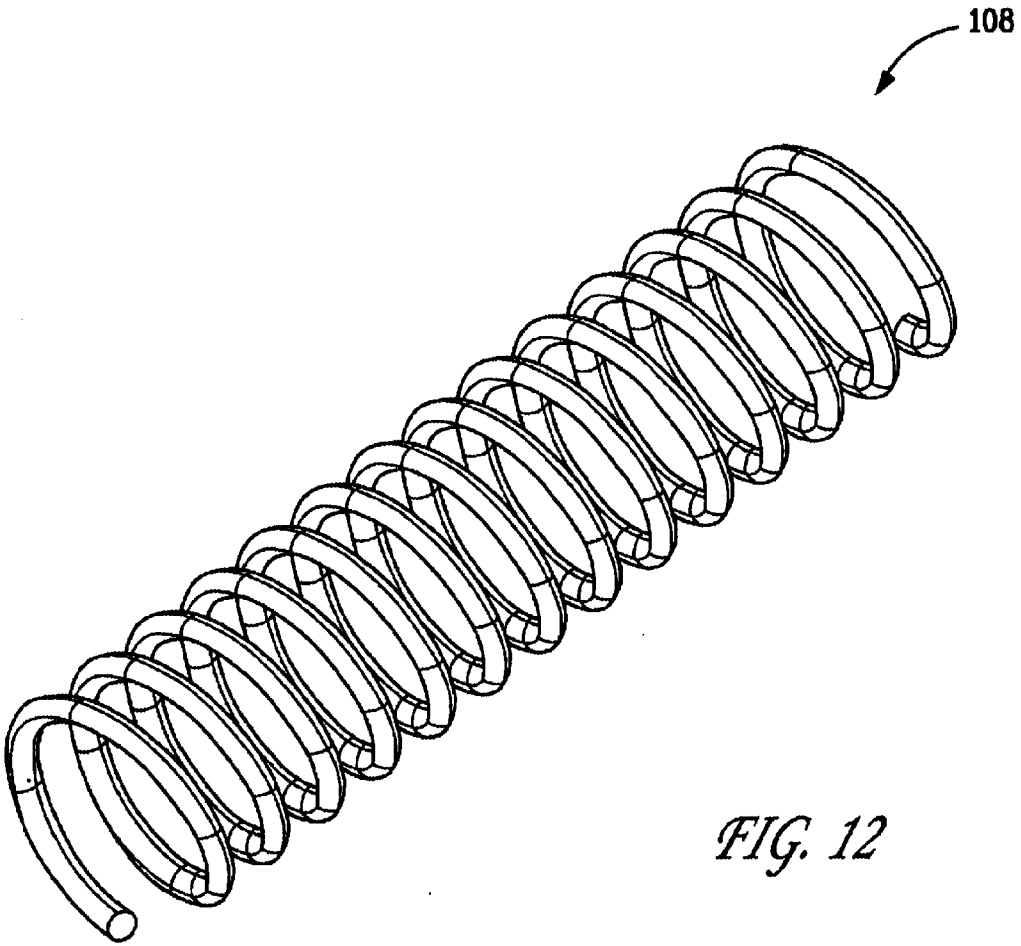
FIG. 12 is a perspective view of the coil spring of the latch of the present invention.
Figure 14:
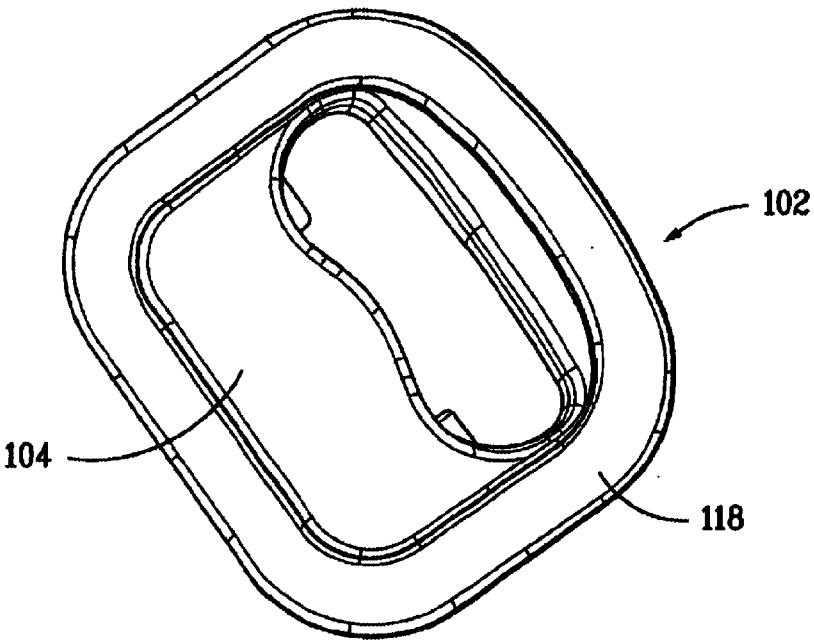
FIGS. 13–14 are views of an assembly including the housing and handle of the latch of the present invention.
Figure 13:
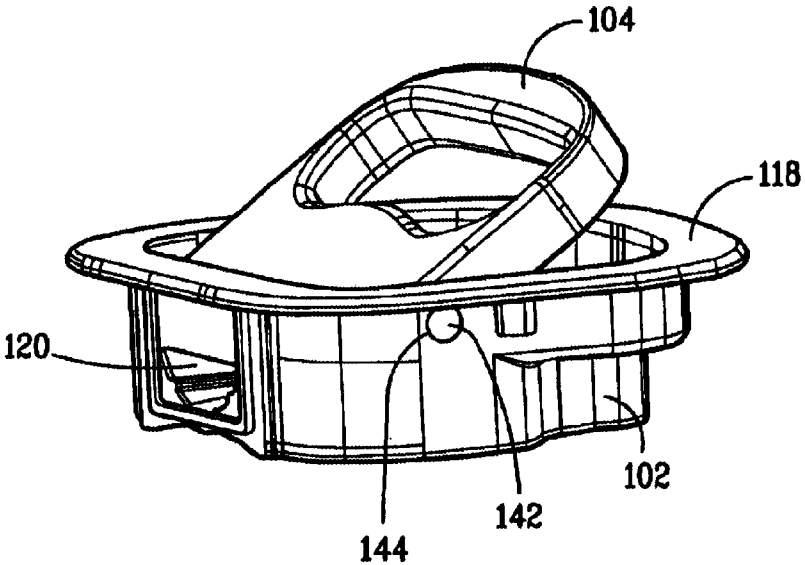
Figure 15:
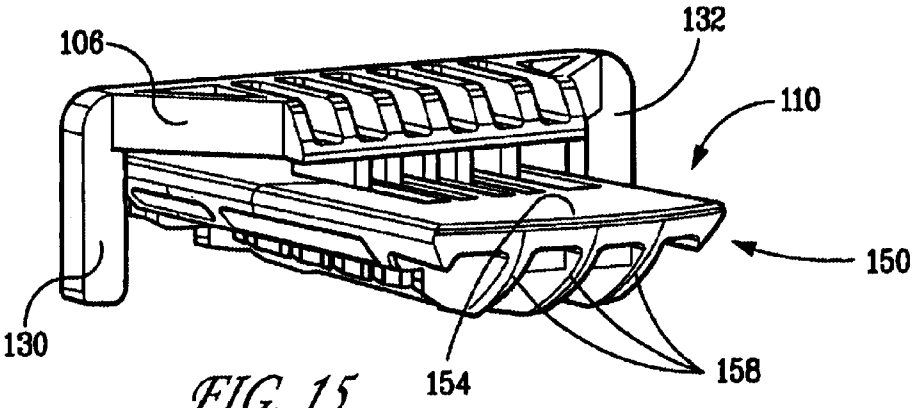
FIGS. 15–16 are views of an assembly including the actuator and pawl of the latch of the present invention.
Figure 16:
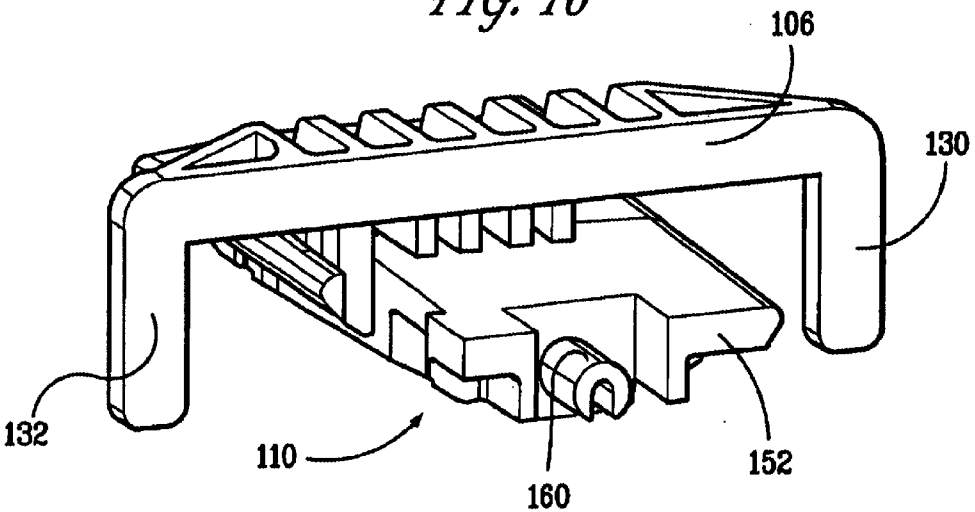
Figure 17:
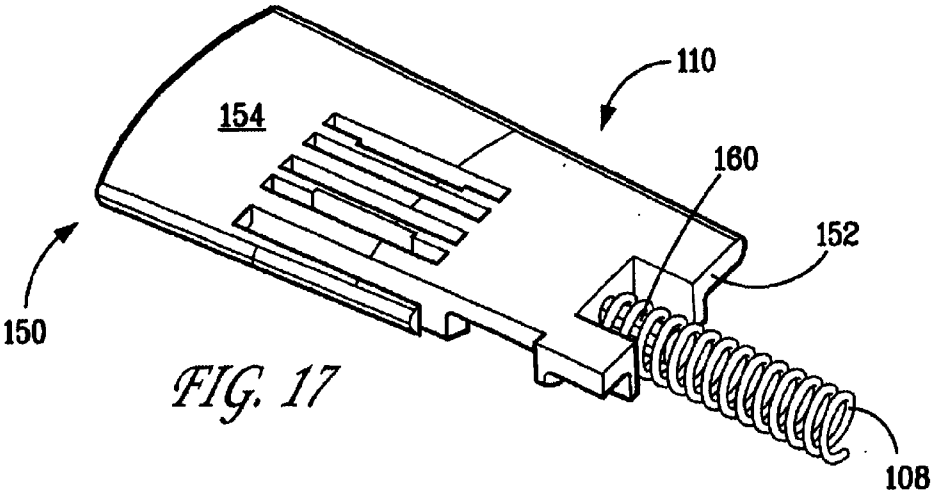
FIGS. 17–18 are views of an assembly including the pawl and coil spring of the latch of the present invention.
Figure 18:
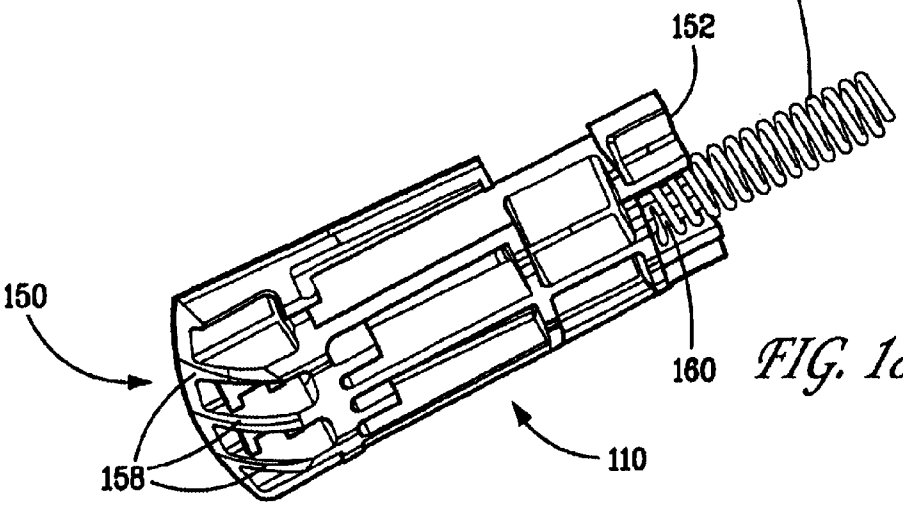
Figure 20:
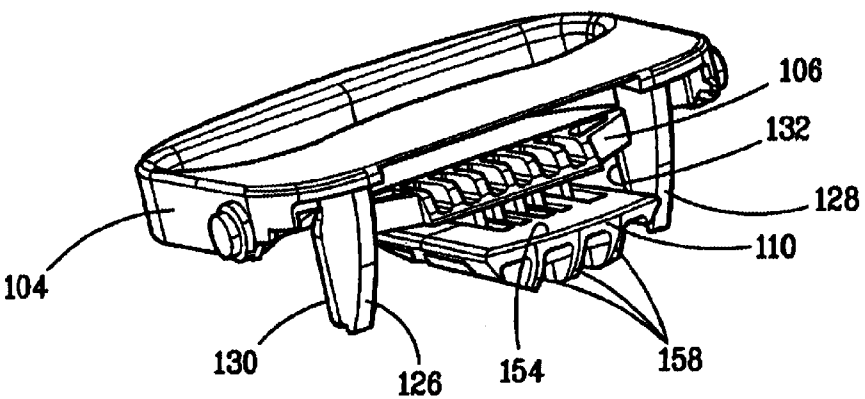
FIGS. 19–20 are views of an assembly including the pawl, spring, actuator, and handle of the latch of the present invention.
Figure 19:
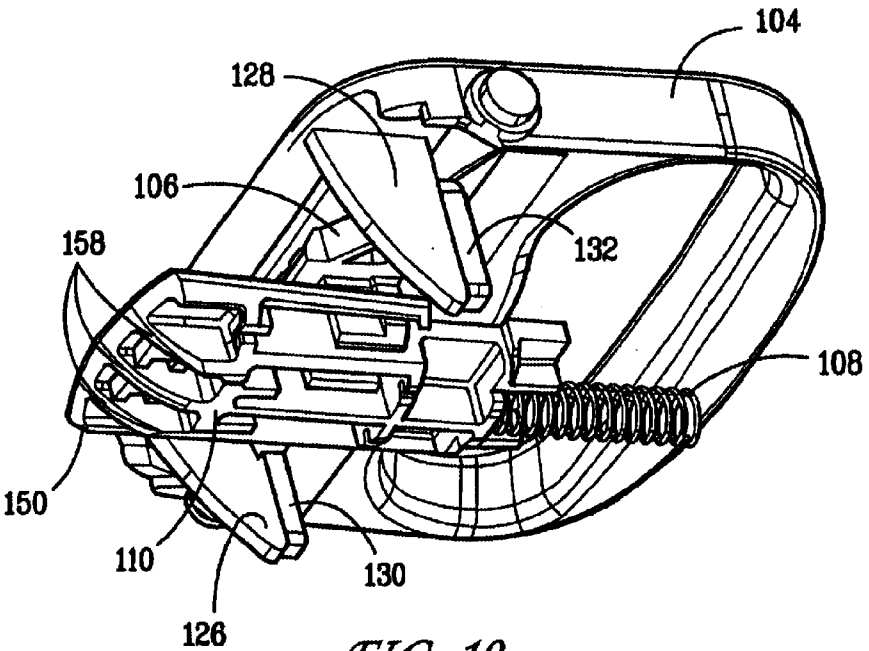

The handle 104 can be in the form of a paddle 104*a*, as shown in FIGS. 2, 5, and 6, or in the form of a ring, as shown in FIGS. 1, 3, 4, and 7–22, to facilitate grasping of the handle by a user using three or four fingers. The handle 104, 104*a* has actuating arms 126 and 128 which extend perpendicularly downward from the underside of the handle. The arms 126 and 128 are located closer to the forward edge 140 of the handle 104, 104*a*. The handle 104, 104*a* also has a pair of cylindrical projections 142 that project from either side of the handle 104, 104*a*. The projections 142 snap into openings 144 to pivotally attach the handle 104, 104*a* to the housing 102. When the handle 104, 104*a* is in the closed position, the handle is received in the cavity 112 such that the top of the handle is flush with the flange 118. This feature gives the latch 100, 100*a* a very low profile, because the flange 118 projects only slightly from the outer surface of the panel 136. The handle 104, 104*a* must be lifted as shown in FIGS. 13 and 22 in order to move the handle to the open position. The handle 104 has a finger hole 146 that is preferably sized to allow insertion of three or four fingers of the user's hand, which allows the handle 104 to be grasped and lifted by a user. The handle 104*a* has a width that is smaller than the width of the cavity 112, thus the rear edge 148 of the handle 104*a* is spaced apart from the open top of the cavity 112. The gap between the rear edge 148 and the open top of the cavity 112 allows a user to insert three or four fingers under the handle 104*a* in order to lift up the handle 104. Otherwise the handles 104 and 104*a*, and the embodiments 100 and 100*a* of the latch of the present invention, are structurally and functionally identical.

As previously stated, the housing 102 is installed in an aperture in the first closure member or panel using any of several well-known fasteners. The bottom receptacle 120 houses the pawl 110 and spring 108 such that the pawl can move in and out of the receptacle 120 with the spring 108 biasing the pawl 110 to project out of the receptacle 120 and toward the latched position. The extended or latched position of the pawl 110 is shown in FIG. 21, while the retracted or unlatched position is shown in FIG. 22. The pawl 110 is in the form of an elongated body and has a forward portion 150 and a rear end 152. The forward portion 150 is wedge-shaped in profile with the top surface 154 of the forward end 150 of the pawl 110 being essentially parallel to the direction of motion of the pawl 110 as the pawl 110 moves between the extended and retracted positions relative to the receptacle 120. The top surface 154 catches the panel frame 156 as shown in FIG. 21 to secure the panel 136 to the frame 156. The wedge-shaped profile of the forward end portion 150 is caused by the presence of the beveled surfaces 158 on the underside of the forward end 150 of the pawl 110. The beveled surfaces 158 engage the frame 156 and cam the pawl 110 to the retracted position as the panel 136 is slammed shut. As is explained below, the spring 108 will subsequently return the pawl 110 to the extended position to secure the panel 136 to the frame 156.

An elongated spring guide 160 projects from a recess in the rear of the pawl 110. The spring guide 160 is surrounded by a portion of the spring 108. The spring 108 is held between the rear of the pawl 110 and the closed end 162 of the receptacle 120 when the latch 100, 100*a* is fully assembled. In the fully assembled latch 100, 100*a* the spring 108 is under compression such that the pawl 110 is biased toward the extended position.

The actuator 106 has a body 164 that is slidably supported by the bottom 114 of the cavity 112. A pair of lateral legs 130, 132 extend downward from either side of the body 164. The lateral legs 130, 132 are positioned in the recesses 122, 124 when the latch 100, 100*a* is fully assembled, and the lateral legs 130, 132 abut the actuating arms 126, 128 of the handle 104, 104*a* with the actuating arms being positioned forward of the lateral legs when the latch is in the latched configuration illustrated in FIG. 21. The bottom 114 of the cavity 112 is provided with one or more, preferably a plurality, of slots 166 that allow the cavity 112 to communicate with the receptacle 120. Each slot 166 has a rear end and a forward end with the rear end being closer the closed end 162 of the receptacle 120. The pawl 110 is also provided with one or more slots 168 that register at least in part with the slots 166. The actuator 106 has one or more, preferably a plurality of, fins 170 that project downward from the bottom of the body 164. Each fin 170 passes through a respective slot 166 and a respective slot 168. One or more of the fins 170 act as snap legs and are provided with projecting ridges 172 that catch on the underside of the pawl 110 after passing through a respective slot 168 to hold the pawl 110, the housing 102, and the actuator 106 together during assembly. Therefore, the fins that have the ridges 172 ease assembly of the latch, but are not essential to its operation. The respective slots 168, for the fins 170 that act as snap legs, are provided with relief cuts 174 that allow the snap leg fins 170 room to flex as the snap leg fin 170 is pushed into its respective slot 168. The relief cut 174 is necessary because of the presence of the ridge 172 that initially causes the ridged fin 170 to flex as the fins 170 are pushed into the respective slots 168. The resilient nature of the ridged fins 170 allows the ridged fin to snap to its original shape once the respective ridge 172 clears the bottom of the pawl 110. Consequently, the ridges 172 catch the bottom of the pawl 110 once the fins 170 are fully inserted into the slots 166 and 168. The width of the fins 170 is smaller than the length of both the slots 166 and the slots 168 such that the fins 170 can move slidably along the length of both the slots 166 and the slots 168.

When the latch 100, 100*a* is in the latched configuration of FIGS. 1, 2, and 21, the fins 170 are captured between the forward ends of the slots 166 and the rear ends of the slots 168 due to the action of the spring 108. In this configuration, the pawl 110 can be pushed by an external force farther into the receptacle 120 and toward the retracted position, against the force of spring 108, without disturbing the actuator 106 or the handle 104, 104*a*. This feature allows for the self-latching action of the pawl 110 as the panel 136 is slammed shut. Lifting the handle 104, 104*a*, as illustrated in FIGS. 13 and 22, causes the actuating arms 126, 128 to push the actuator 106 and in turn the pawl 110, against the pressure of spring 108, toward the closed end 162 of the receptacle 120 until the pawl 110 reaches its fully retracted position as shown in FIG. 22. The panel 136 can then be opened, i.e. lifted away from the frame 156.

As already stated, the handle 104, 104*a* is pivotally supported by the housing 102 and has actuating arms 126, 128 that impinge upon lateral legs 130, 132 of the actuator 106. When the latch handle is lifted out of the first depression 112 of the housing 102, the actuating arms 126, 128 of the handle push on the lateral legs 130, 132 and thus move the actuator 106 toward the closed rear end 162 of the receptacle 120. As the actuator 106 is moved rearward relative to the housing 102, the actuator 106 in turn retracts the pawl 110 to the unlatched position. The actuator 106 is supported such that the actuator 106 moves linearly with the pawl 110 and in a direction parallel to the direction of movement of the pawl 110 rearward within the receptable 120 as the handle 104, 140*a* is moved pivotally toward the open position.

During closing of the first closure member 136, one or more beveled surfaces 158, provided on the underside of the pawl 110, cooperate with the second closure member 156 to slide the pawl to the unlatched position as the first closure member 136 is slammed shut. The coil spring 108 then moves the pawl 110 to the latched position once the pawl clears the edge of the second closure member 156, such that the pawl 110 will catch the underside of the second closure member 156. Thus, the first closure member 136 is releasably secured in place.

Referring to FIGS. 23–30, a third embodiment of the present invention can be seen. The third embodiment of the latch of the present invention includes a housing 202, a handle 204, a coil spring 208, and a pawl 210.

The latch housing 202 has a cavity or depression 212 which receives the handle 204 when the handle is in the closed position, in a manner similar to that shown for the first two embodiments. The depression 212 has an essentially enclosed bottom 214 and an open top 216 surrounded by a bezel or flange 218. The latch housing further has a receptacle 220 attached to the underside of the enclosed bottom 214 of the depression 212. The receptacle 220 houses the coil spring 208 and the pawl 210. The handle 204 is provided with actuating arms 226 and 228. A pair of bosses 234 project downward from the flange 218. The bosses 234 are blended into the exterior surface of the walls of the cavity 212. Similar to the first embodiment 100, the housing 202 is installed to a loadfloor panel 136 by providing an opening 138 in the loadfloor panel 136. The perimeter of the opening 138 should be smaller than the perimeter of the flange 218. The housing 202 is installed in the opening 138 with the underside of the flange 218 abutting the outer surface of the panel 136. The panel 136 should have cutouts for the bosses 234, or be otherwise dimensioned and/or configured to allow access to the bosses 234 from the underside of the panel 136. The housing 202 can then be secured to the panel 136 using, for example, self-tapping screws which engage the bosses 234 from the underside of the panel 136.

Figure 24:
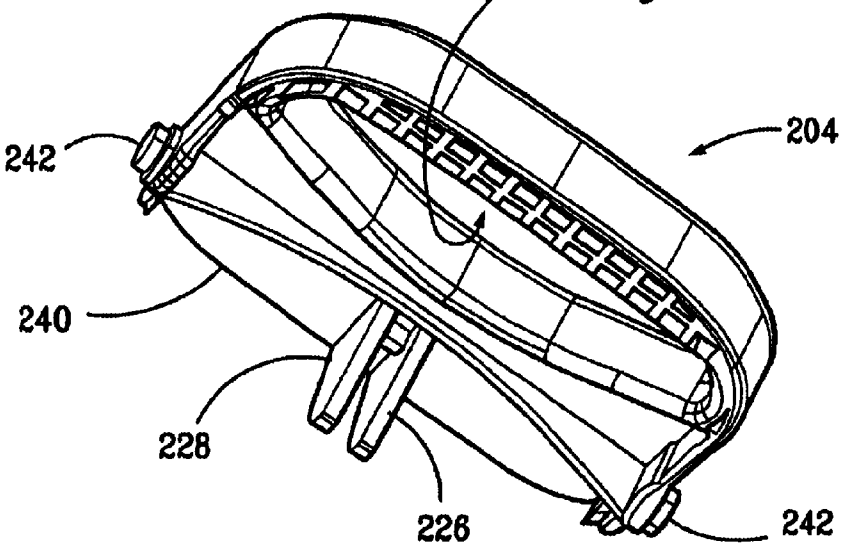
FIGS. 23–24 are views of the latch handle of the third embodiment of the present invention.
Figure 23:
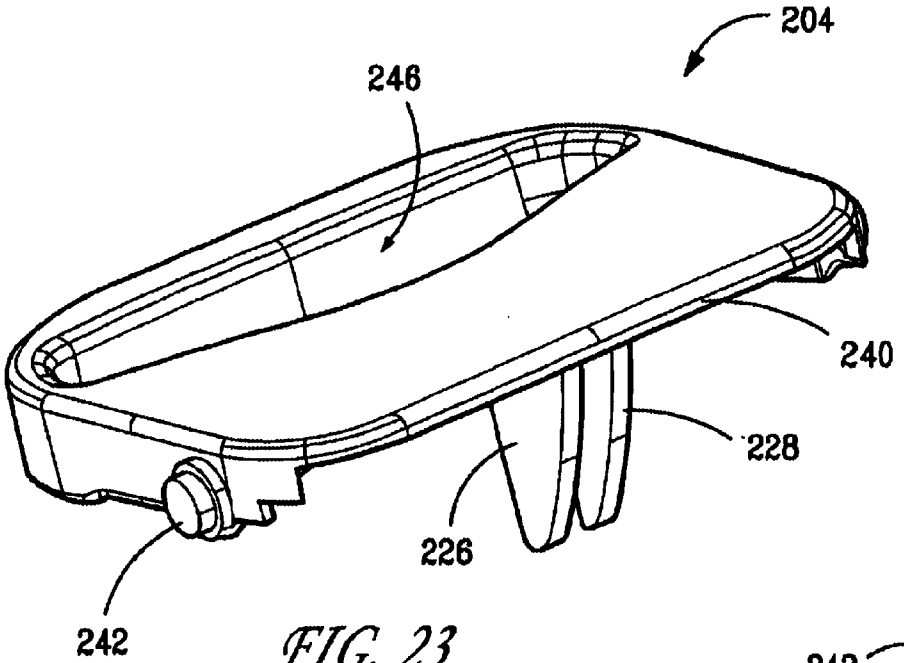
Figure 26:
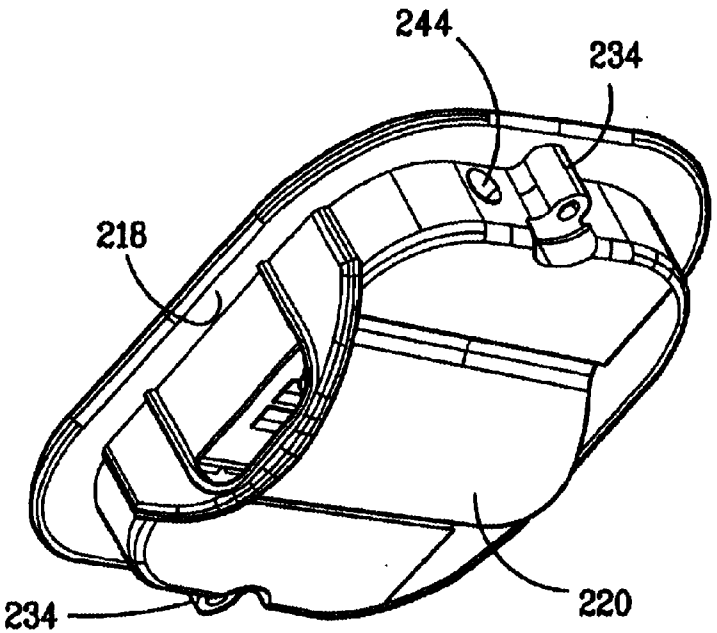
FIGS. 25–26 are views of the housing of the third embodiment of the latch of the present invention.
Figure 25:
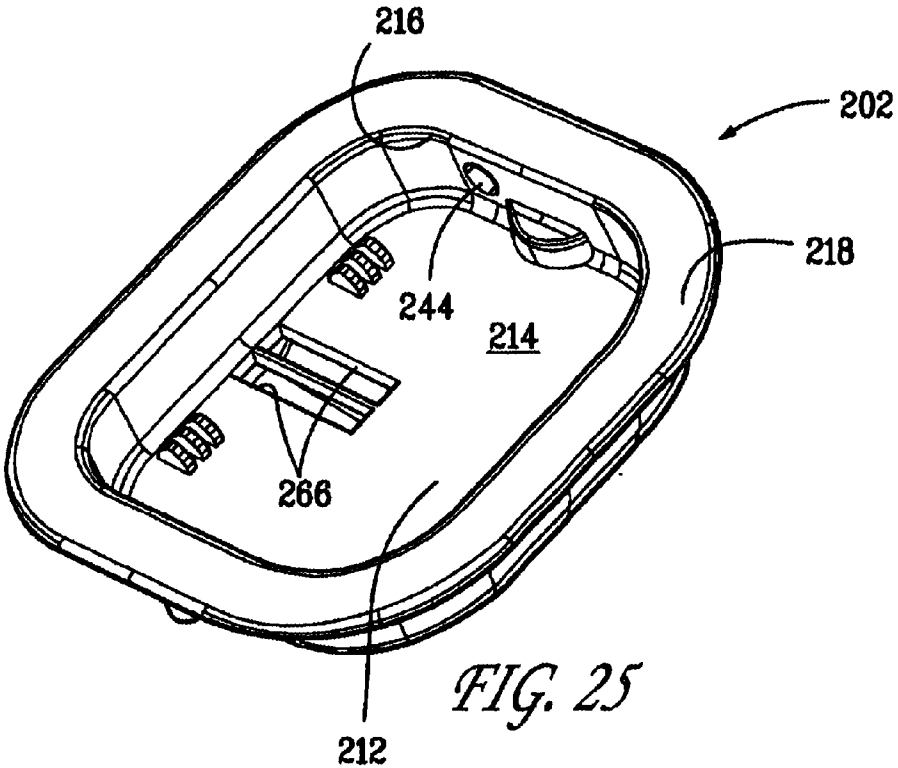
Figure 27:
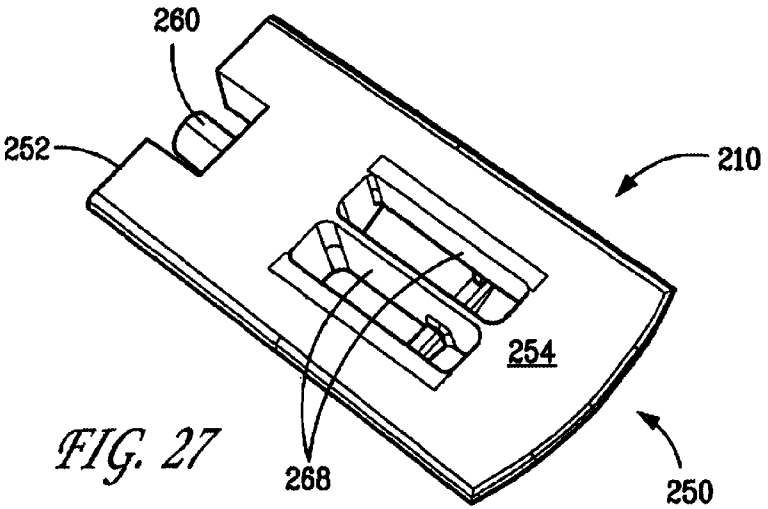
FIGS. 27–28 are views of the pawl of the third embodiment of the latch of the present invention.
Figure 28:
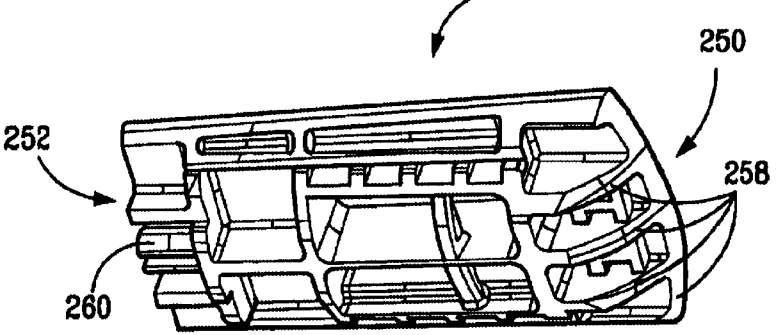
Figure 30:
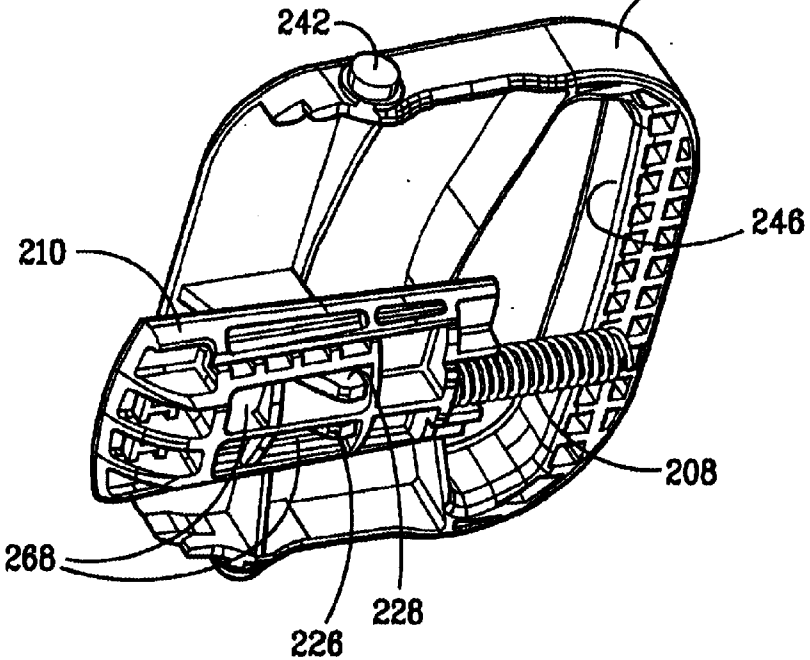
FIGS. 29–30 are views of an assembly including the pawl, spring, and handle of the third embodiment of the latch of the present invention.
Figure 29:
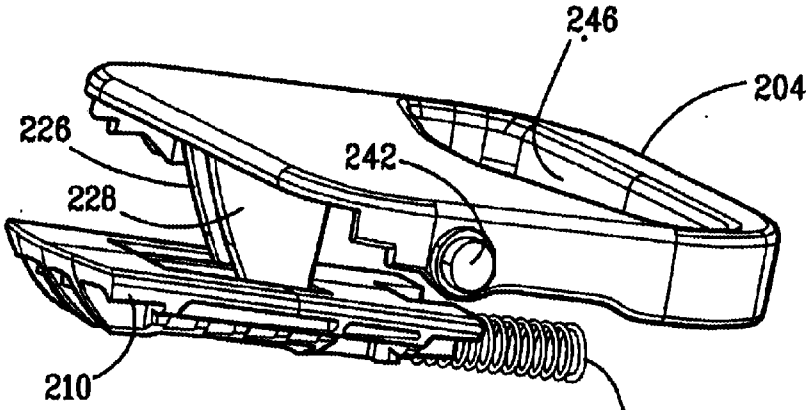
Figure 31:
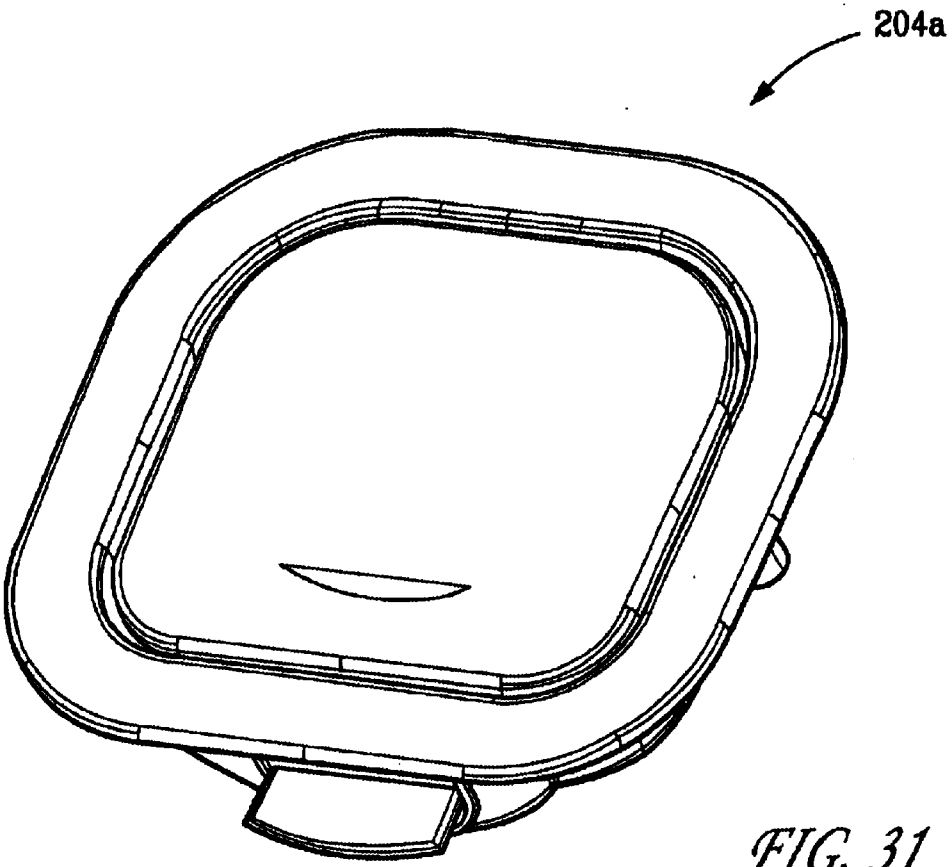
FIG. 31 is a top perspective view of an alternate handle for the third embodiment of the invention attached to the housing.
Figure 33:
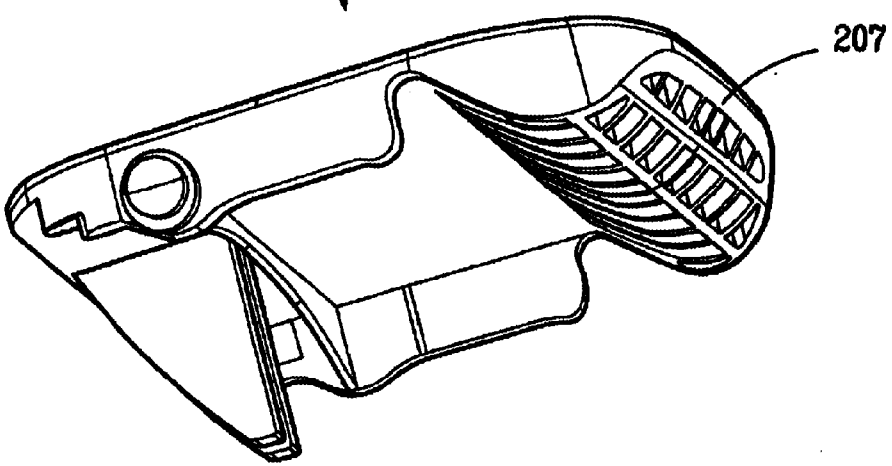
FIG. 33 is a bottom perspective view of an alternate handle for the third embodiment of the invention.
Figure 32:
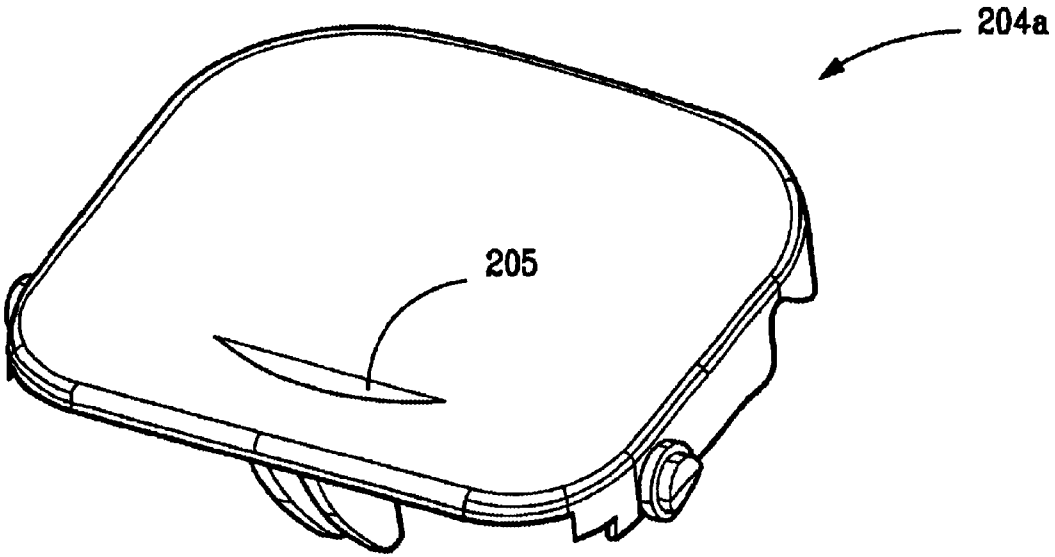
FIG. 32 is a top perspective view of an alternate handle for the third embodiment of the invention.

The handle 204 may be in the form of a ring to facilitate grasping of the handle by a user using three or four fingers as shown in FIGS. 23–24 or the handle 204 can be in the form of a paddle as shown in FIGS. 31–33. In the paddle embodiment, the user will press the handle down at one end having a depression cavity 205 next to the pivot point, this action will lift the other end of the handle wherein the user can grab the handle grip portion 207 from behind and pull up the handle 204A until the pawl 210 is disengaged. The handle 204, 204A has actuating arms 226 and 228 which extend perpendicularly downward from the underside of the handle. The arms 226 and 228 are located closer to the forward edge 240 of the handle 204, 204A. The handle 204, 204A also has a pair of cylindrical projections 242 that project from either side of the handle 204, 204A. The projections 242 snap into openings 244 to pivotally attach the handle 204, 204A to the housing 202. When the handle 204, 204A is in the closed position, the handle 204, 204A is received in the cavity 212 such that the top of the handle is flush with the flange 218. This feature gives the third embodiment, shown in FIGS. 23–30, a very low profile, because the flange 218 projects only slightly from the outer surface of the panel 136. The handle 204, 204A must be lifted, in the same manner as shown in FIGS. 13 and 22, in order to move the handle 204, 204A to the open position. The handle 204 has a finger hole 246 that is preferably sized to allow insertion of three or four fingers of the user's hand, which allows the handle 204 to be grasped and lifted by a user.

As previously stated, the housing 202 is installed in an aperture in the first closure member or panel using any of several well-known fasteners. The bottom receptacle 220 houses the pawl 210 and spring 208 such that the pawl can move in and out of the receptacle 220 with the spring 208 biasing the pawl 210 to project out of the receptacle 220 and toward the latched position. The extended or latched position of the pawl 210 is similar to the extended position for the pawl 110 as shown in FIG. 21, while the retracted or unlatched position of the pawl 210 resembles the retracted condition of the pawl 110 as shown in FIG. 22. The pawl 210 is in the form of an elongated body and has a forward portion 250 and a rear end 252. The forward portion 250 is wedge-shaped in profile with the top surface 254 of the forward end 250 of the pawl 210 being essentially parallel to the direction of motion of the pawl 210 as the pawl 210 moves between the extended and retracted positions relative to the receptacle 220. The top surface 254 catches the panel frame 156 in the same manner as shown in FIG. 21 for the pawl 110, to secure the panel 136 to the frame 156. The wedge-shaped profile of the forward end portion 250 is caused by the presence of the beveled surfaces 258 on the underside of the forward end 250 of the pawl 210. The beveled surfaces 258 engage the frame 156 and cam the pawl 210 to the retracted position as the panel 136 is slammed shut. As is explained below, the spring 208 will subsequently return the pawl 210 to the extended position to secure the panel 136 to the frame 156.

An elongated spring guide 260 projects from a recess in the rear of the pawl 210. The spring guide 260 is surrounded by a portion of the spring 208. The receptacle 220 has a closed end similar to the closed end 162 of the receptacle 120 and an open end similar to the open end of the receptacle 120. The spring 208 is held between the rear of the pawl 210 and the closed end of the receptacle 220 when the latch of FIGS. 23–30 is fully assembled. In the fully assembled latch, the spring 208 is under compression such that the pawl 210 is biased toward the extended position.

The bottom 214 of the cavity 212 is provided with one or more, preferably a plurality, of slots 266 that allow the cavity 212 to communicate with the receptacle 220. Each slot 266 has a rear end and a forward end with the rear end being closer the closed end of the receptacle 220. The pawl 210 is also provided with one or more slots 268 that register at least in part with the slots 266. The actuating arms 226 and 228 project through the slots 266 and into the slots 268 when the latch of FIGS. 23–30 is fully assembled. The width of the actuating arms 226 and 228 is smaller than the length of both the slots 268 such that the pawl 210 can move slidably relative to the actuating arms 226 and 228. The slots 268 also have rear ends which are closer to the rear end 252 of the pawl 210 and forward ends that are closer to the forward end 250 of the pawl 210.

When the latch of FIGS. 23–33 is in the latched configuration, the handle 204, 204A is positioned in the cavity 212, the rear ends of the slots 268 abut the actuating arms 226 and 228, and the pawl 210 is in the extended position due to the action of the spring 208. In this configuration, the pawl 210 can be pushed by an external force farther into the receptacle 220 and toward the retracted position, against the force of spring 208, without disturbing the actuating arms 226 and 228 and the handle 204, 204A. This feature allows for the self-latching action of the pawl 210 as the panel 136 is slammed shut. Lifting the handle 204, 204A in a manner similar to that illustrated in FIGS. 13 and 22 with regard to handle 104, causes the actuating arms 226, 228 to push the pawl 210, against the pressure of spring 208, toward the closed end of the receptacle 220 until the pawl 210 reaches its fully retracted position. The panel 136 can then be opened, i.e. lifted away from the frame 156.

As already stated, the handle 204, 204A is pivotally supported by the housing 202 and has actuating arms 226, 228 that impinge upon the rearward ends of the slots 268. When the latch handle is lifted out of the cavity 212 of the housing 202, the actuating arms 226, 228 of the handle push on the rearward ends of the slots 268 and thus move the pawl 210 toward the closed rear end of the receptacle 220. Thus, as the handle 204, 204A is pivotally moved out of the cavity 212, the pawl 210 is moved to the retracted or unlatched position.

During closing of the first closure member 136, one or more beveled surfaces 258, provided on the underside of the pawl 210, cooperate with the second closure member 156 to slide the pawl to the unlatched position as the first closure member 136 is slammed shut. The coil spring 208 then moves the pawl 210 to the latched position once the pawl clears the edge of the second closure member 156, such that the pawl 210 will catch the underside of the second closure member 156. Thus, the first closure member 136 is releasably secured in place.

It is to be understood that the present invention is not limited to the embodiments described above, but encompasses any and all embodiments within the scope of the following claims.

I claim:

1. A latch for releasably securing a closure member in a closed position, the latch comprising:

a housing adapted for being received in an aperture formed in the closure member, said housing having a first cavity having a bottom and an open top, said bottom having an underside, said housing further having a receptacle attached to said underside of said bottom of said first cavity, said housing further including second and third cavities positioned on either side of said receptacle and extending downward from said bottom, each of said second and third cavities having open tops;

a handle pivotally attached to said housing and movable between an open and a closed position, said handle being received in said first cavity when said handle is in said closed position, said handle having a pair of actuating arms each housed in a respective one of said second and third cavities;

a pawl slideably supported by said housing so as to be movable between a latched and an unlatched position, said pawl being biased toward said latched position, said pawl projecting from said receptacle when in said latched position, and said pawl being retracted inward within said receptacle when said pawl is in said unlatched position; and an actuator slideably supported at least in part within said first cavity and being engageable to said pawl, said actuator having a pair of lateral legs each of which extends into a respective one of said second and third cavities and is engaged by a respective one of said pair of actuating arms as said handle is moved pivotally from closed position toward said open position, said actuator being supported such that said actuator moves linearly with said pawl and in a direction parallel to a direction of movement of said pawl rearward within said receptacle as said handle is moved pivotally toward said open position, whereby pivotal movement of said handle to said open position causes said pawl to retract to said unlatched position.

2. The latch of claim 1, wherein said open top of said first cavity is surrounded by a flange which contacts the closure member in the installed position, wherein a pair of cylindrical sleeves extend downward from said flange for securing said housing to the closure member, wherein said flange and said handle are flush in the closed position.

3. The latch of claim 1, wherein said bottom of said first cavity has a first plurality of slots, said pawl member has a plurality of slots, said actuator has a plurality of fins that extend through said first plurality of slots and engage said second plurality of slots as said handle is moved toward said open position to thereby move said pawl toward said unlatched position.

4. The latch of claim 3, wherein said pawl further comprises a spring guide attached to a rear end, wherein a first end of a biasing means is supported on said spring guide, wherein a second end of said biasing means contacts a rear portion of said receptacle, whereby the pawl is biased toward said latched position.

5. The latch of claim 4, wherein said actuator arms of said handle drive rearward said lateral legs of said actuator during actuation of the latch thereby retracting said pawl and disengaging said latch from a frame, when said pawl is initially in a latched position and the closure member is in a closed position relative to the frame.

6. The latch of claim 3, wherein said pawl has an underside, at least one of said plurality of fins has a projecting ridge and a respective one of said second plurality of slots has a relief cut for snap fit attachment of said actuator and said pawl, and said projecting ridge catches a portion of said underside of said pawl adjacent said respective one of said second plurality of slots so as to resist said actuator being pulled apart from said pawl.

7. The latch of claim 1, wherein said pawl member has a front end having a flat top surface and a beveled bottom surface, wherein said beveled surface engages a frame and cams said pawl member to the retracted position thereby allowing slam-action engagement to a frame.

* * * * *

UNITED STATES PATENT AND TRADEMARK OFFICE

CERTIFICATE OF CORRECTION

PATENT NO. : 6,719,332 B2
DATED : April 13, 2004
INVENTOR(S) : Ivica Sekulovic

It is certified that error appears in the above-identified patent and that said Letters Patent is hereby corrected as shown below:

Column 9,
Line 7, before "plurality of slots," insert -- second --.

Signed and Sealed this

Sixth Day of July, 2004

JON W. DUDAS
*Acting Director of the United States Patent and Trademark Office*